US007350665B2

(12) United States Patent
Hembert

(10) Patent No.: US 7,350,665 B2
(45) Date of Patent: Apr. 1, 2008

(54) DEVICE TO PROTECT THE DOMES AND ENDS OF A COMPOSITE TANK

(76) Inventor: Claude Leon Hembert, 43 rue des Bordes, 36400 La Chatre (FR)

( * ) Notice: Subject to any disclaimer, the term of this patent is extended or adjusted under 35 U.S.C. 154(b) by 259 days.

(21) Appl. No.: 10/636,014

(22) Filed: Aug. 6, 2003

(65) Prior Publication Data

US 2004/0026437 A1 Feb. 12, 2004

Related U.S. Application Data

(63) Continuation of application No. 09/936,093, filed on Mar. 26, 2002, now abandoned.

(51) Int. Cl.
*B65D 25/26* (2006.01)
*B65D 90/12* (2006.01)

(52) U.S. Cl. ..... 220/632; 220/592

(58) Field of Classification Search ..... 220/586, 220/592, 626, 627, 630, 632, 636, 737, 647, 220/649; 215/376; 410/47
See application file for complete search history.

(56) References Cited

U.S. PATENT DOCUMENTS

| | | | | |
|---|---|---|---|---|
| 3,349,940 | A * | 10/1967 | Cornelius | 220/592.19 |
| 4,573,603 | A * | 3/1986 | Starling et al. | 220/605 |
| 4,815,605 | A * | 3/1989 | Brissier et al. | 206/523 |
| 4,867,348 | A * | 9/1989 | Dorfman | 222/173 |
| 5,004,120 | A * | 4/1991 | Hembert | 220/589 |
| 5,906,286 | A * | 5/1999 | Matsuno et al. | 215/375 |
| 6,793,095 | B1 * | 9/2004 | Dulisse et al. | 220/612 |

* cited by examiner

*Primary Examiner*—Anthony D. Stashick
*Assistant Examiner*—Harry A Grosso
(74) *Attorney, Agent, or Firm*—Cantor Colburn LLP

(57) ABSTRACT

Disclosed are a device for protecting a container and a container equipped therewith. The container is, in particular, a container made of composite material intended to contain a fluid under pressure, and having a cylindrical side wall and rounded ends forming a dome. The device includes a shell made of a puncture-resistant material, shaped to envelope at least the entirety of the dome of the container, delimiting a space between an interior face of the shell and an exterior face of the wall of the container, and a compressible element capable of deadening a knock or impact, disposed in the space.

16 Claims, 2 Drawing Sheets

DEVICE TO PROTECT THE DOMES AND ENDS OF A COMPOSITE TANK

CROSS REFERENCE TO RELATED APPLICATION

This application is a continuation application of, and claims full benefits of, U.S. patent application Ser. No. 09/936,093, filed on Mar. 26, 2002, now abandoned which is herein incorporated by reference in its entirety.

FIELD OF THE INVENTION

The present invention relates to a device for protecting a container and to a container equipped with this device.

DESCRIPTION OF THE RELATED ART

It has become commonplace for use to be made of composite materials in order to produce containers intended to contain a fluid under pressure. These containers may be vats, tanks or bottles, and may be made in particular of glass, aramide or carbon fibers embedded in a matrix. This type of container generally comprises a cylindrical side wall and rounded ends, commonly known as "domes", and a connecting piece located at the top of one and/or other of the domes.

These composite materials have numerous advantages for this application but do, however, have the disadvantage of having highly varying resistance to knocks and droppages of the containers, depending on the nature of the fibers used. In particular, containers produced by carbon-fiber filament winding are highly sensitive to such knocks or droppages.

The bases of the domes are the thinnest parts of the wall of a container and are therefore the weakest. A knock on or droppage onto one of these domes produces delamination of the internal layers of composite material, which leads to a drop in the mechanical ability of the container to withstand the pressure of the fluid and therefore leads to a risk of this container bursting.

To solve this problem, it has been envisioned, for a container obtained by winding fibers, to place a protective insert made of a knock or impact absorbing or deadening material, particularly polyurethane foam, on each dome of this container, then for this insert to be covered with an external winding of reinforcing fibers embedded in a matrix.

This method is satisfactory on the whole, but retains various drawbacks, namely:

- increased winding time;
- insert-covering layers which constitute additional material which plays no part in the ability of the container to withstand the pressure of the fluid and which make this container heavier;
- a thinning of the insert at its ends, that is to say toward the side wall of the container on the one hand, and toward the top of the dome on the other hand, to allow this insert to be covered over without the covering layers experiencing breaks in level; this insert therefore protects the container essentially against "oblique" droppages, that is to say droppages where the axis of the container makes an angle of about 45° with the impact surface, but affords this container practically no protection against knocks on the top of the dome, in the case of a "vertical" droppage, that is to say a droppage where the axis of the container is roughly perpendicular to the impact surface, or against knocks on the portion of the container side wall adjacent to the base of the dome, in the case of "horizontal" droppage, that is to say a droppage where the axis of the container makes a small or zero angle with this same impact surface.

Either one of these two types of droppage therefore carries the risk of causing the aforementioned internal delamination of the base of the dome.

SUMMARY OF THE INVENTION

The present invention sets out to overcome these drawbacks by providing a protective device which is simple and inexpensive to implement, does not make the container significantly heavier, and affords this container perfect protection in the event of droppage, regardless of the angle that the axis of this container makes with the impact surface.

To this end, this protective device comprises:

- a shell made of a puncture-resistant material, shaped to envelope at least the entirety of a dome of the container, delimiting a space between its interior face and the exterior face of the wall of the container (1); and
- a compressible material capable of deadening a knock or impact, filling the entirety of the aforementioned space.

This device is therefore produced independently of the container, that is to say without fitting a protective insert and winding fibers round it when manufacturing the container. As a result of its shape which envelopes at least the entirety of the dome, and as a result of the space between said shell and the wall of the container being completely filled, the device spreads perfectly uniformly the impacts that the container may suffer, with the compressible material possibly compressing in order to deaden this knock at the time of this impact.

What this means is that this device allows the dome of the container to be protected efficiently regardless of the angle formed, at the time of impact, between the axis of this container and the impact surface.

The shell may be made in particular of synthetic resin, particularly of thermoplastic resin such as acrylonitrile-butadiene-styrene or polycarbonate, while said compressible material may be expanded polystyrene, a polyurethane or polyethylene foam, or any other expanded synthetic material.

Advantageously, the device is shaped to cover not only the entirety of the dome of the container but also the portion of the side wall of the container that is adjacent to the base of this dome.

The enveloping of this portion enhances the protection of the container against "horizontal" droppages.

The device may have a roughly constant thickness, that is to say that the shell may thus "follow" the wall of the container; however, as a preference, this shell has, at the end corresponding to the side wall of the container, a wall roughly parallel to the axis of the container and, at the end corresponding to the top of the dome of the container, a wall perpendicular to this axis, these two walls meeting in the form of a rounded zone.

Through this shape, the device has a thickness which is markedly increased where it faces the thinnest part of the dome, this further improving the protection afforded to the container against "oblique" droppages.

Advantageously, when the device is intended to equip a container comprising a connecting piece situated at the top of a dome, it comprises an annular projection, the height of which is such that it extends beyond the free end of this connecting piece when the device is placed on this dome.

In the event of a "vertical" droppage, this projection makes it possible to perfectly protect the connecting piece against any direct impact.

The device may be fixed to the container non-removably, by any appropriate means, for example by bonding; it may equally be mounted removably on this container, so that the wall of the latter can be periodically inspected.

According to one preferred embodiment of the invention which can be used on containers comprising a connecting piece, this connecting piece is threaded at its free end and the device is shaped to surround this connecting piece in such a way that the exterior face of the shell is set back from the threaded free end of the connecting piece, and comprises a tapped ring which can be screwed onto said connecting piece and bear against said shell in order to mount the device on the dome.

BRIEF DESCRIPTION OF THE DRAWINGS

To allow a good understanding thereof, the invention is described once again hereinbelow with reference to the appended schematic which, by way of nonlimiting example, depicts one preferred embodiment of the device to which the invention relates.

DETAILED DESCRIPTION OF THE PREFERRED EMBODIMENT

Figure 1:
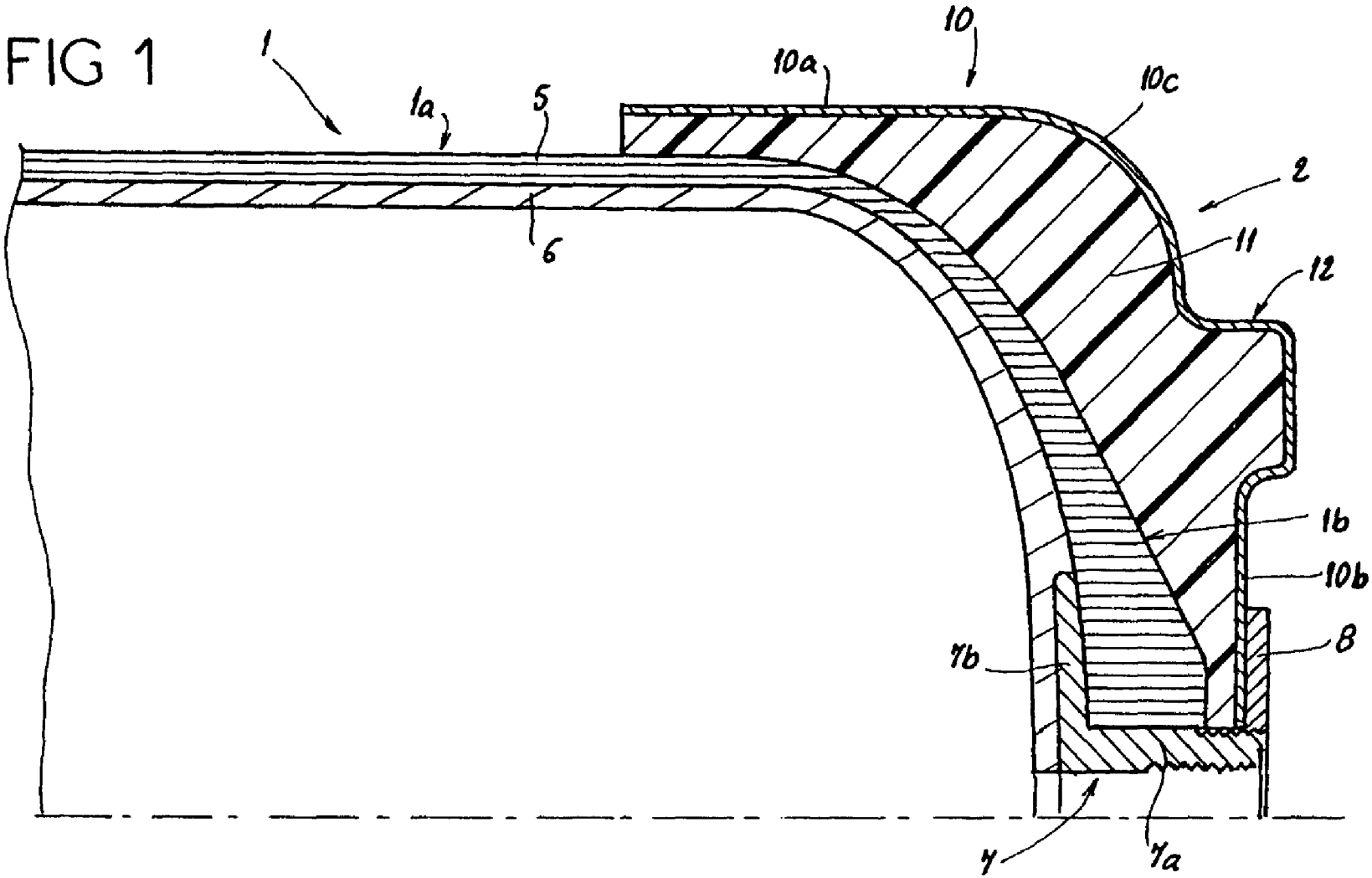
FIG. 1 is a half view thereof when it is mounted on a tank, in longitudinal section.

FIG. 1 depicts part of the side wall 1*a* and of the rounded end 1*b*, known as a "dome", of a tank 1 made of composite material, this tank being fitted with a device 2 for protecting its wall against knocks or droppages.

The tank 1 is of the type intended to contain a fluid under pressure, and comprises of wall 5 made of composite material, an interior lining wall 6 and a metal connecting piece 7 for connecting this tank 1 to the installation that needs to be supplied with fluid.

The connecting piece 7 comprises a tubular part 7*a*, which is threaded and tapped at its free end, and a circular base 7*b*. The tapping in the part 7*a* allows the aforementioned connection while the thread allows the screwing-on of a tapped ring 8 for removably mounting the device 2 on the tank 1. The base 7*b* is sandwiched between the walls 5 and 6 to make sure that the connecting piece 7 is mounted firmly on the tank 1.

The device 2 comprises an external shell 10 which envelopes the entirety of the dome 1*b* and a portion of the wall 1*a* adjacent to the base of this dome 1*b*, and a filling 11 made of a compressible material occupying all of the space delimited by the exterior face of the wall 5, the part 7*a* of the connecting piece 7 and the interior face of the shell 10.

The latter is made of a puncture-resistant material, particularly a thermoplastic resin such as acrylonitile-butadiene-styrene or polycarbonate. At the end corresponding to the wall 1*a*, it has a wall 10*a* roughly parallel to the axis of the tank 1 and, at the end corresponding to the top of the dome 1*b*, it has a wall 10*b* perpendicular to this same axis, these walls 10*a* and 10*b* meeting in a rounded region 10*c*. The result of this structure is that the filling 11 is thick where it faces the part of the dome 1*b* at the end corresponding to the wall 1*a*, in which part this dome 1*b* has its smallest thickness.

The shell 10 further comprises an annular projection 12, the height of which is such that it extends beyond the free end of the connecting piece 7 and the ring 8 when the device 2 is mounted on the tank 1.

The material of which the filling 11 is made is capable of deadening a knock or an impact thanks to its compressibility, it being possible for this material to be expanded polystyrene, polyurethane foam or any other expanded synthetic material.

Because of its shape which envelopes not only the dome 1*b* but also said portion of the wall 1*a*, and because of the filling 11 which occupies the entirety of the space between said shell 10 and the wall of the tank 1, the device 2 spreads perfectly any impact that this tank may suffer.

Figure 2:
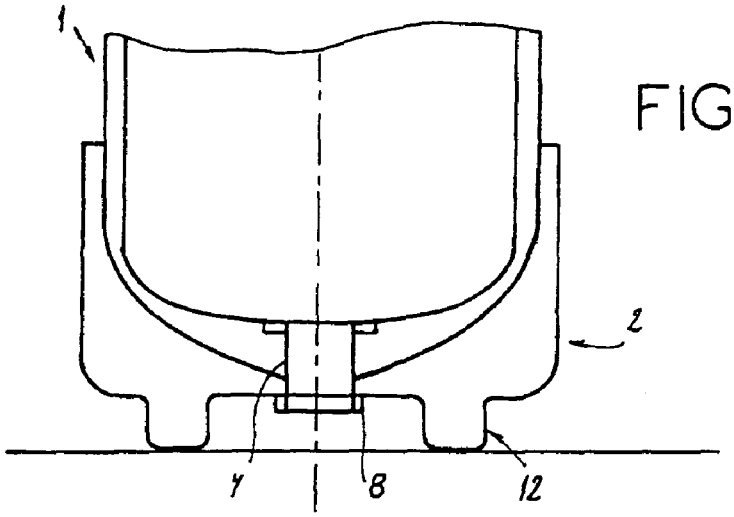
FIGS. 2 to 4 are views thereof in longitudinal section on a smaller scale, in the event of, respectively: (i) a "vertical" droppage, that is to say where the axis of the tank is roughly perpendicular to the impact surface at the time of the impact, (ii) an "oblique" droppage, that is to say where this axis makes an angle of roughly 45° with said impact surface at the time of the impact, and (iii) a "horizontal" droppage, that is to say where this axis forms a small or zero angle with said surface at the time of the impact.

FIG. 2 more particularly shows that the projection 12 perfectly protects the connecting piece 7 and the ring 8, and therefore the wall of the tank 1, against any direct impact in the event of a "vertical" droppage.

Figure 3:
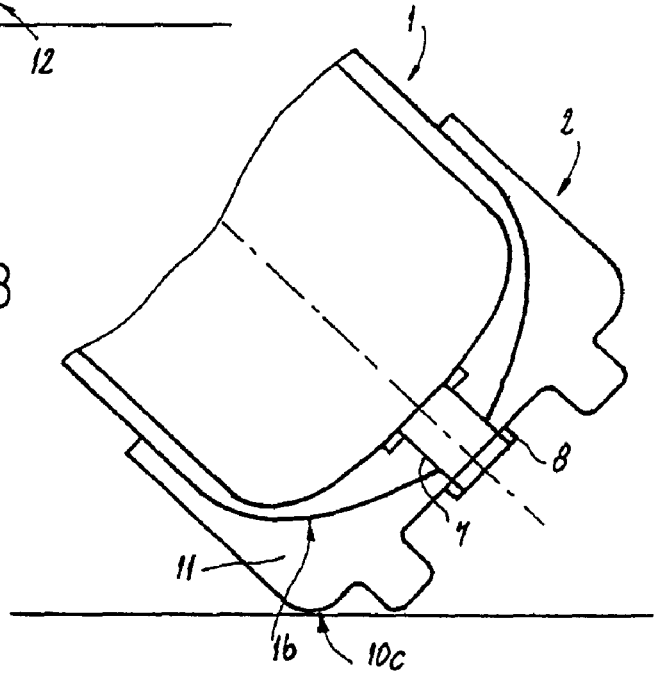

FIG. 3 shows that the rounded wall 10*c* and the maximum thickness of the filling 11 facing this wall 10*c* perfectly protect the part of the dome 1*b* which lies at the end corresponding to the wall 1*a*.

Figure 4:
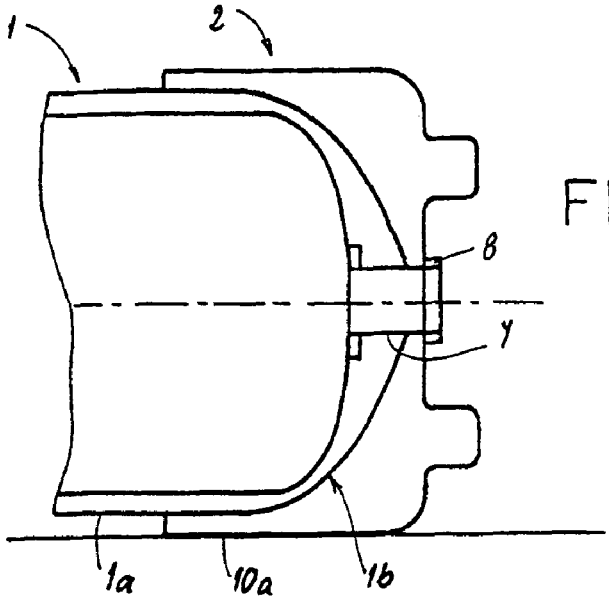

FIG. 4, for its part, shows that the wall 10*a* provides the dome 1*b* and the wall 1*a* with prefect protection in the event of a "horizontal" droppage.

The connecting piece 7 and the ring 8 allow the device 2 to be mounted removably on the tank 1, so that this device 2 does not form any impediment to inspecting the wall of this tank 1.

The invention also provides a device that makes it possible to overcome the drawbacks of the corresponding devices of the prior art because it is simple and inexpensive to employ, does not make the container significantly heavier, and affords this container perfect protection in the event of a droppage, regardless of the angle formed between the axis of this container and the impact surface.

It goes without saying that the invention is not restricted to the embodiment described hereinabove by way of example but that, on the contrary, it encompasses all alternative forms of embodiment thereof. Thus, in the case of small-sized containers such as bottles, the exterior side face of the projection 12 could be in the continuation of the wall 10*a*.

The invention claimed is:

1. Device for protecting a container having a cylindrical side wall and rounded ends forming a dome, the device comprising:

a shell made of a puncture-resistant material, shaped to envelope at least the entirety of the dome of the container and comprising an annular projection disposed in proximity to a connecting piece of the container, the shell delimiting a space between an interior face of the shell and an exterior face of the wall of the container, wherein the shell includes a rounded zone that delimits a region of greatest volume in the space between the interior face of the shell and exterior face of the wall of the container, wherein the shell has, at an end corresponding to the side wall of the container, a first wall roughly parallel to an axis of the container and, at an end corresponding to a top of the dome of the container, a second wall perpendicular to the axis, the first and second walls meeting in the form of a rounded zone, wherein the annular projection is formed on the second wall; and a compressible element capable of deadening a knock or impact, disposed in the space, wherein the shell is made of a synthetic resin.

2. Device according to claim 1, wherein the compressible element comprises an expanded synthetic material selected from the group consisting of polystyrene, a polyurethane and polyethylene foam.

3. Device according to claim 1, wherein the device is shaped to cover not only the entirety of the dome of the container but also a portion of the side wall of the container that is adjacent to a base of the dome.

4. Device according to claim 1, wherein the connecting piece is situated at a top of the dome and the annular projection has a height such that the annular projection extends beyond a free end of the connecting piece when the device is placed on the dome.

5. Device according to claim 1, wherein the device is mounted removably on the container.

6. Device according to claim 4, wherein the connecting piece is threaded at the free end, and the device is shaped to surround the connecting piece in such a way that an exterior face of the shell is set back from the threaded free end of the connecting piece, the device further comprising a tapped ring which can be screwed onto the connecting piece and bear against the shell in order to mount the device on the dome.

7. Container comprising:

a tank including a cylindrical side wall and rounded ends forming a dome; and a device including a shell made of a puncture-resistant material, shaped to envelope at least the entirety of the dome and comprising an annular projection disposed in proximity to a connecting piece of the container, the shell delimiting a space between an interior face of the shell and an exterior face of the wall of the container, wherein the shell includes a rounded zone that delimits a region of greatest volume in the space between the interior face of the shell and exterior face of the wall of the container, the device further including a compressible element disposed in the space and capable of deadening a knock or impact, wherein the shell has, at an end corresponding to the side wall of the container, a first wall roughly parallel to an axis of the container and, at an end corresponding to a top of the dome of the container, a second wall perpendicular to the axis, the first and second walls meeting in the form of a rounded zone, wherein the annular projection is formed on the second wall, wherein the shell is made of a synthetic resin.

8. Container according to claim 7, wherein the compressible element comprises an expanded synthetic material selected from the group consisting of polystyrene, polyurethane and polyethylene foam.

9. Container according to claim 7, wherein the shell is shaped to cover not only the entirety of the dome but also a portion of the side wall that is adjacent to a base of the dome.

10. Container according to claim 7, wherein the connecting piece is situated at a top of the dome and the annular projection has a height such that the annular projection extends beyond a free end of the connecting piece.

11. Container according to claim 10, wherein the device is mounted removably on the tank.

12. Container according to claim 10, wherein the connecting piece is threaded at the free end, and the device is shaped to surround the connecting piece in such a way that an exterior face of the shell is set back from the threaded free end of the connecting piece, the device further comprising a tapped ring which can be screwed onto the connecting piece and bear against the shell in order to allow mounting of the device on the dome.

13. Container according to claim 7, wherein the synthetic resin is a thermoplastic resin selected from the group consisting of acrylonitrile-butadiene-styrene and polycarbonate.

14. Container according to claim 7, wherein the synthetic resin is a thermoplastic resin.

15. Container according to claim 14, wherein the thermoplastic resin is selected from the group consisting of acrylonitrile-butadiene-styrene resin and polycarbonate resin.

16. Container according to claim 7, wherein the container is composed of a composite material intended to contain a fluid under pressure.

* * * * *